US005634183A

United States Patent [19]

Saito et al.

[11] Patent Number: 5,634,183

[45] Date of Patent: May 27, 1997

[54] IMAGE PRINTER

[75] Inventors: Yosuke Saito, Hitachinaka; Hirobumi Ouchi, Mito; Yasuo Kikuchi, Hitachinaka; Katsuhiro Akinaga, Hitachinaka; Tomio Sugaya, Hitachinaka, all of Japan

[73] Assignee: Hitachi Koki Co., Ltd., Tokyo, Japan

[21] Appl. No.: 608,154

[22] Filed: Feb. 28, 1996

[30] Foreign Application Priority Data

Mar. 3, 1995 [JP] Japan ..... 7-043965
Sep. 8, 1995 [JP] Japan ..... 7-230941

[51] Int. Cl.[6] ..... G03G 15/09

[52] U.S. Cl. ..... 399/277; 399/228

[58] Field of Search ..... 118/658, 657, 118/645; 355/251, 326, 327

[56] References Cited

U.S. PATENT DOCUMENTS

| | | | |
|---|---|---|---|
| 5,247,317 | 9/1993 | Corver et al. | 118/657 X |
| 5,311,262 | 5/1994 | Shimizu et al. | 355/251 |
| 5,446,526 | 8/1995 | Shimizu | 355/251 |
| 5,491,541 | 2/1996 | Yokoyama et al. | 355/251 |

FOREIGN PATENT DOCUMENTS

| | | |
|---|---|---|
| SHO 55-101969 | 8/1980 | Japan . |

*Primary Examiner*—R. L. Moses
*Attorney, Agent, or Firm*—Bardehle, Pagenberg, Dost, Altenburg, Frohwitter, Geissler and Partners

[57] ABSTRACT

In an image printer performing multi-color printing, two magnetic poles having the same polarity are provided adjacent to each other in a position facing the printing body of the second developing agent holding body provided in the second developing unit, and development is performed under a condition satisfying the following formulas;

$B1 \leqq 1100$, $1000 \leqq B2 \leqq 1200$, $-300 \leqq B1-B2 \leqq 0$, $F \approx 0$ where B1 (gauss) is a magnetic flux density on the surface of the developing agent holding body of one magnetic pole of the magnetic poles arranged in the downstream side of the transmitting direction of the developing agent, and B2 (gauss) is a magnetic flux density on the surface of the developing agent holding body of the other magnetic pole of the magnetic poles arranged in the upstream side of the transmitting direction of the developing agent, and F (gf) is a rubbing force to the printing body of the magnetic brush in the second developing unit.

3 Claims, 5 Drawing Sheets

RELATIONSHIP BETWEEN MAGNETIC FLUX DENSITY B1 AND COLOR MIXING RATIO

RELATIONSHIP BETWEEN MAGNETIC FLUX DENSITY B2 AND COLOR MIXING RATIO

RELATIONSHIP BETWEEN B1-B2 AND COLOR MIXING RATIO

RELATIONSHIP BETWEEN MAGNETIC FLUX DENSITY B2 AND AMOUNT OF SPATTERED CARRIER

RELATIONSHIP BETWEEN B1 AND B2

RELATIONSHIP BETWEEN RUBBING FORCE AND COLOR MIXING RATIO

IMAGE PRINTER

BACKGROUND OF THE INVENTION

1. Field of the Invention

The present invention relates to an image printer and, more particularly, to an image printer in which a multi-color toner image is formed on a printing body.

2. Description of the Prior Art

As a method printing with a plurality of colors using an image printer utilizing electrophotographic method such as a copying machine, a laser printer or the like, there is known a method where by providing a plurality of developing units containing different color toners, a first color image is formed on a printing body by performing a first charging process, a first exposing process and a first developing process to the printing body, and successively a second color image is formed on the printing body by performing a second charging process, a second exposing process and a second developing process to the printing body, and then the first color and the second color toner images are transferred onto a print material such as a sheet of paper at a time.

In a case of forming the second color toner image onto the printing body on which the first color toner image exists, there arises a problem in that the first color toner image is disturbed by a magnetic brush of the developing unit for the second color when the printing body passes by the developing unit for the second color, the scraped toner enters into the developing unit for the second color and is finally mixed with the second color toner to print an image having a color tone different from its original.

In a case of using a two-component developing agent composed of a toner and a carrier as the developing agent, there are deviations in the particle size and the magnetic characteristic (saturation magnetization) of a carrier used, and a carrier having a small particle size or a small saturation magnetization is apt to be attached onto a printing body since such a carrier is held with a small force by the developed magnetic pole. Once the carrier is attached onto the printing body, the carrier interrupts supplying of toner to an electrostatic latent image formed formed thereon. As a result, this causes omitted letters and accordingly degrades the printing quality.

SUMMARY OF THE INVENTION

An object of the present invention is to provide an image printer which is hardly causes color mixing when multi-printing is performed.

Another object of the present invention is to provide an image printer in which carrier is hardly attached onto its printing body.

The object of the present invention can be attained by providing an image printer which comprises a first developing unit having a first developing agent holding body rotatably supported, forming a magnetic brush composed of a developing agent containing a toner and a carrier in the peripheral portion of the first developing agent holding body, developing a first electrostatic latent image formed on a printing body using the magnetic brush to form a first toner image onto the printing body; a second developing unit having a first developing agent holding body rotatably supported, forming a magnetic brush composed of a developing agent containing a toner and a carrier in the peripheral portion of the second developing agent holding body, developing a second electrostatic latent image formed on the printing body using the magnetic brush to form a second toner image onto the printing body holding the first toner image; wherein two magnetic poles having the same polarity are provided adjacent to each other in a position facing the printing body of the second developing agent holding body provided in the second developing unit; development being performed under a condition satisfying the following formulas; $B1 \leqq 1100$, $1000 \leqq B2 \leqq 1200$, $-300 \leqq B1-B2 \leqq 0$, where B1 (gauss) is a magnetic flux density on the surface of the developing agent holding body of one magnetic pole of the magnetic poles arranged in the downstream side of the transmitting direction of the developing agent, and B2 (gauss) is a magnetic flux density on the surface of the developing agent holding body of the other magnetic pole of the magnetic poles arranged in the upstream side of the transmitting direction of the developing agent.

According to the present invention, sufficient magnetic holding force to hold carrier can be obtained without color mixing by defining the magnetic flux densities of the first and the second magnetic flux polarization patterns, and the force to scrape a first color toner image formed on a printing body can be eliminated since the rubbing force of the magnetic brush in the second developing unit to the printing body is decreased to nearly 0 (zero).

DETAILED DESCRIPTION OF THE PREFERRED EMBODIMENTS

Figure 1:
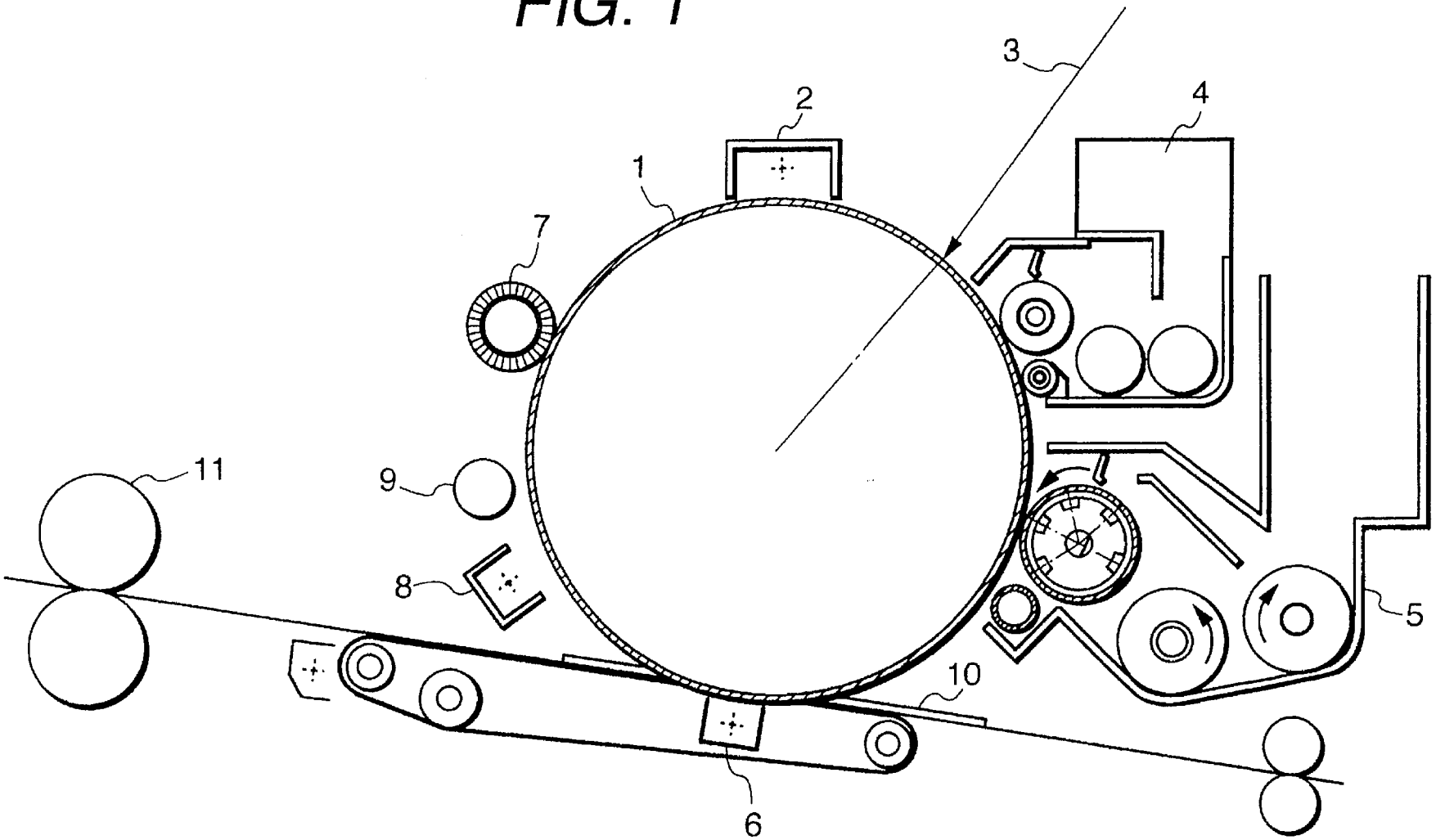
FIG. 1 is a cross-sectional view showing an embodiment of an image printer in accordance with the present invention.

An embodiment of the present invention will be described in detail below, referring to the accompanying drawings. This embodiment will be explained by taking an example where the present invention is applied to a two-color printing laser printer. In FIG. 1, the reference character 1 indicates a printing body composed of a photosensitive body and so on. Around the printing body 1, there are arranged a charger 2, a developing unit 5 for first color containing a two-component developing agent composed of black toner and carrier, a developing unit 4 for second color containing a two-component developing agent composed of red toner and carrier, a transferring unit 6, a pre-charger 8, an erasing lamp 9 and a cleaner 7. The carrier used is a ferrite carrier of which the bulk density is 2.2–2.7 g/cm$^2$, the saturation magnetization is 20–60 emu/g and the mixing ratio to the toner is 2~5 wt %. The charging polarity of the toner for the first color is set the same as that for the second color.

In a case of performing two-color printing using a two-color printing laser printer having the above-mentioned construction, the developing unit 4 for the second color, the transferring unit 6 and the cleaner 7 are drawn backward from the printing body 1 in advance, and in the first turn of the printing body 1 the surface of the printing body 1 is uniformly charged by corona discharge using the charger 2, and a first electrostatic latent image is formed by a beam 3 generated by a light source (not shown) such as a gas laser, a semiconductor laser, an LED or the like, and then a first toner image is formed on the printing body 1 using the developing unit 5 for first color.

After that, in the second turn of the printing body 1, the developing unit 5 for first color is drawn backward, and the developing unit 4 for second color 4, the transferring unit 6 and the cleaner 6 are accessed to the printing body 1, the surface of the printing body 1 is uniformly charged by corona discharge using the charger 2, and a second electrostatic latent image is formed by a beam 3, and then a second toner image is formed on the printing body 1 using the developing unit 4 for second color. After the first and the second toner images formed on the printing body 1 are transferred onto a sheet of paper 10 with the transferring unit 6, the transferred images are fixed by heating and pressing actions of, for instance, a roll 11.

The construction of a developing roll of the developing unit 4 for second color will be described below, referring to FIG. 2.

Figure 2:
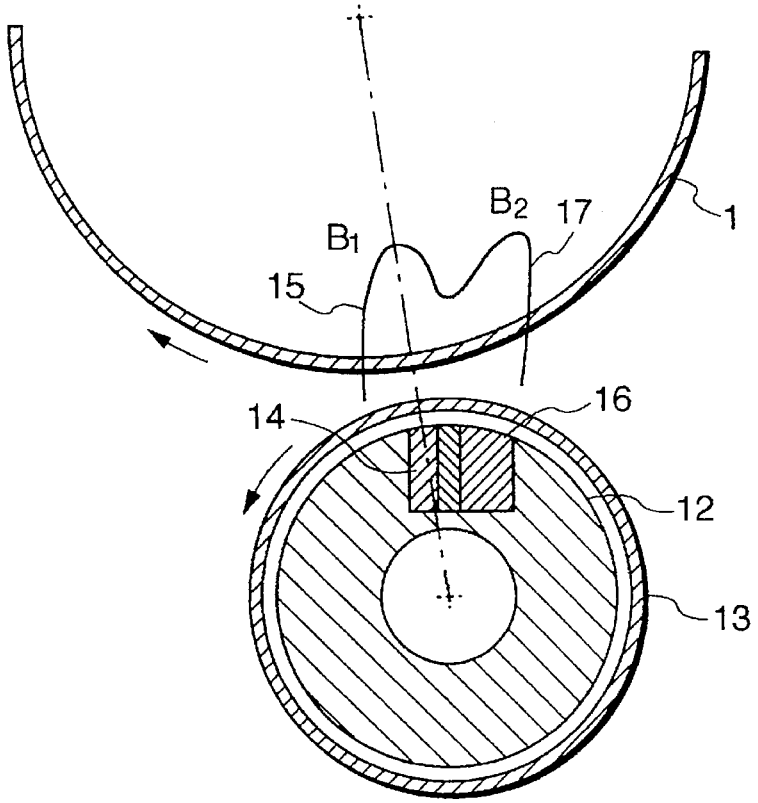
FIG. 2 is an explanatory view showing the construction of a developing magnetic pole.

In FIG. 2, the reference character 12 indicates a cylindrical magnet. The cylindrical magnet 12 in the present embodiment is formed of an isotropic magnet in order to obtain a uniform and stable magnetic flux polarization pattern. The periphery of the fixed cylindrical magnet 12 is surrounded with a sleeve 13 which is rotatably installed in the direction shown by an arrow in the figure. In a position where the printing body 1 faces the sleeve 13, a magnet piece 14 and a magnet piece 16 are provided, and the magnet piece 16 is arranged in the upstream side of the rotating direction of the sleeve 13 in regard to the magnet piece 14. The magnet piece 14 and the magnet piece 16 in this embodiment are formed of anisotropic magnets in order to obtain comparatively large magnetic forces larger than 1000 gauss.

The magnet piece 14 produces a magnetic flux polarization pattern 15 having a magnetic flux density B1, and the magnet piece 16 produces a magnetic flux polarization pattern 17 having a magnetic flux density B2. A repulsive force is produced between the magnet piece 14 and the magnet piece 16 since the both are of the same polarity. Further, the magnet pieces are arranged so that the position of the peak value of the magnetic flux polarization pattern 15 comes on a straight line connecting between the rotation center of the printing body 1 and the rotation center of the cylindrical magnet 12.

Figure 3:
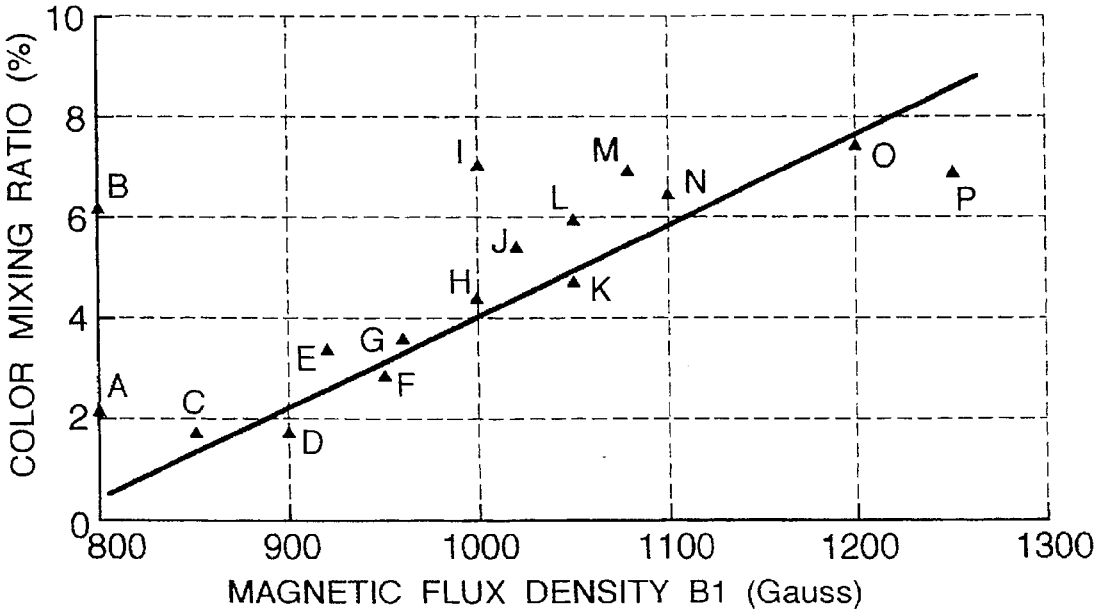
FIG. 3 is an explanatory graph showing the relationship between magnetic flux density B1 and color mixing ratio.
Figure 4:
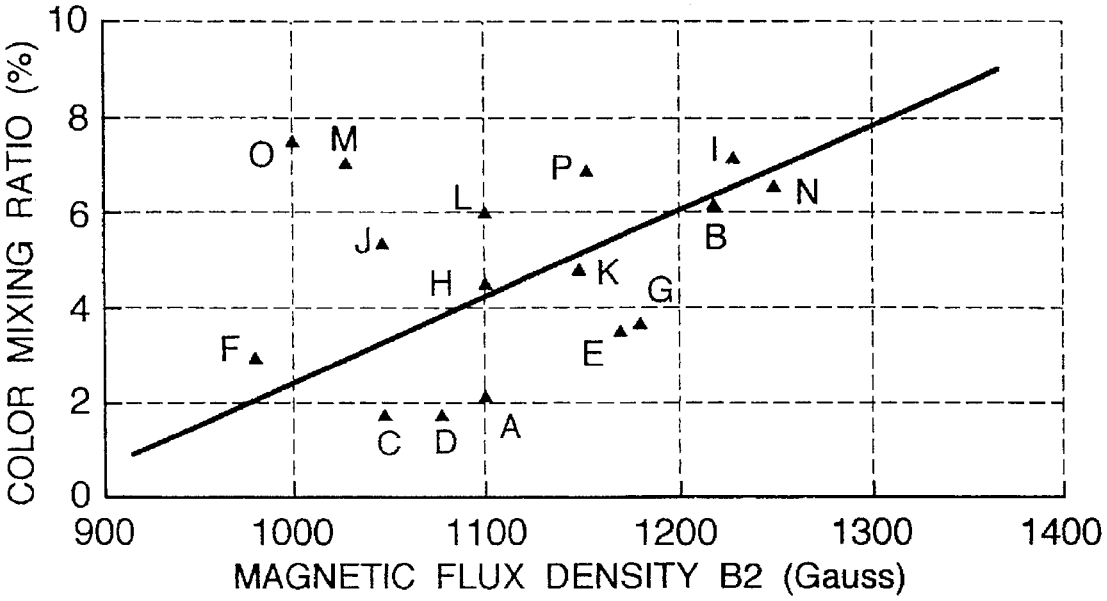
FIG. 4 is an explanatory graph showing the relationship between magnetic flux density B2 and color mixing ratio.

Description will be made on the results of experiments in which the values of the magnetic flux polarization patterns 15 and 17 are varied in the construction described above, as shown by patterns A~P in FIG. 3~FIG. 5. Although color mixing changes depending on materials and printing conditions, it is likely to be saturated by printing pages of approximately 200~500. Therefore, the color mixing ratio is obtained from an areal ratio in an image after printing of 1000 pages using an image analyzing apparatus. FIG. 3 and FIG. 4 show the relationships between the magnetic flux densities B1, B2 and the color mixing ratio for the second color. The color mixing ratio, except for experimental points B and I, is approximately proportional to the magnetic flux density B1 of the magnetic flux polarization pattern 15, and it can be understood that the color mixing ratio can be decreased by decreasing the magnetic flux density B1. In general, when the color mixing ratio is smaller than 6%, the image can be practically used without any trouble. It is clarified that the magnetic flux density B1 of the magnetic flux polarization pattern 15 is set to lower than 1100 gauss in order to suppress the color mixing ratio smaller than 6%.

Figure 5:
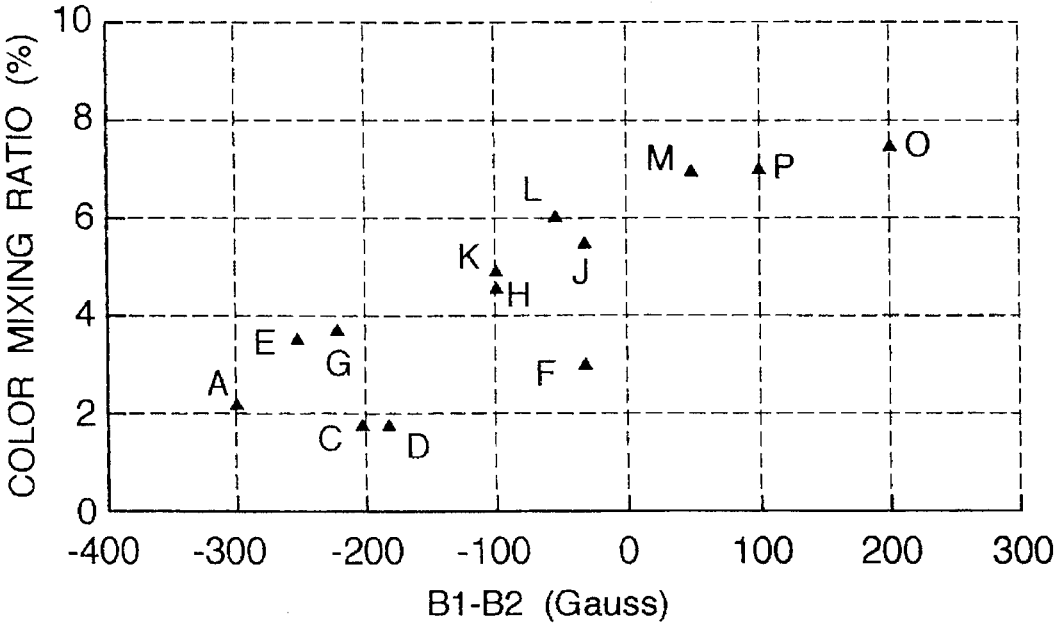
FIG. 5 is an explanatory graph showing the relationship (B1–B2) and color mixing ratio.

As for the relationship between the magnetic flux density B2 of the magnetic flux polarization pattern 17 and the color mixing ratio, there are some experimental points having high color mixing ratios such as experimental points O, M in FIG. 4 even at small values of the magnetic flux density, and accordingly it cannot be observed any clear correlation between them. However, it can be understood from FIG. 3 that the deviations of experimental points O, P are caused from the magnitudes of magnetic flux density B1. By removing these experimental points, it can be understood that the color mixing ratio increases as the magnetic flux density B2 is increased since the magnetic flux density B2 in the portion of the magnetic flux polarization pattern 17 also rubs the toner image. Therefore, it is required that the magnetic flux B2 is smaller than 1200 gauss. It can be further understood that the experimental points B and I in FIG. 3 are affected by the large values of the magnetic flux density B2. From the above reason, the relationship between (B1–B2) and the color mixing ratio is plotted within the ranges of B1≦1100 gauss, B2≦1200 gauss to obtain FIG. 5. In FIG. 5, the color mixing ratio increases as (B1–B2) is increased, that is, when B1≦B2. In other words, it is clarified that the practical range of the (B1–B2) is −300~0 gauss. Therefore, it is possible to suppress the color mixing ratio below 6% by setting the main poles as B1≦1100 gauss, B2≦1200 gauss and −300 gauss ≦(B1–B2)≦0 gauss. It is preferable in order to suppress the color mixing ratio to 2~5% that the main poles are set as B1≦1000 gauss, B2≦1100 gauss and −300 gauss ≦(B1–B2)≦−100 gauss. In the case of the color mixing ratio of 2~5%, the image quality is not degraded since scraping of the first color image is decreased as well as the color mixing in the color image is decreased.

Figure 6:
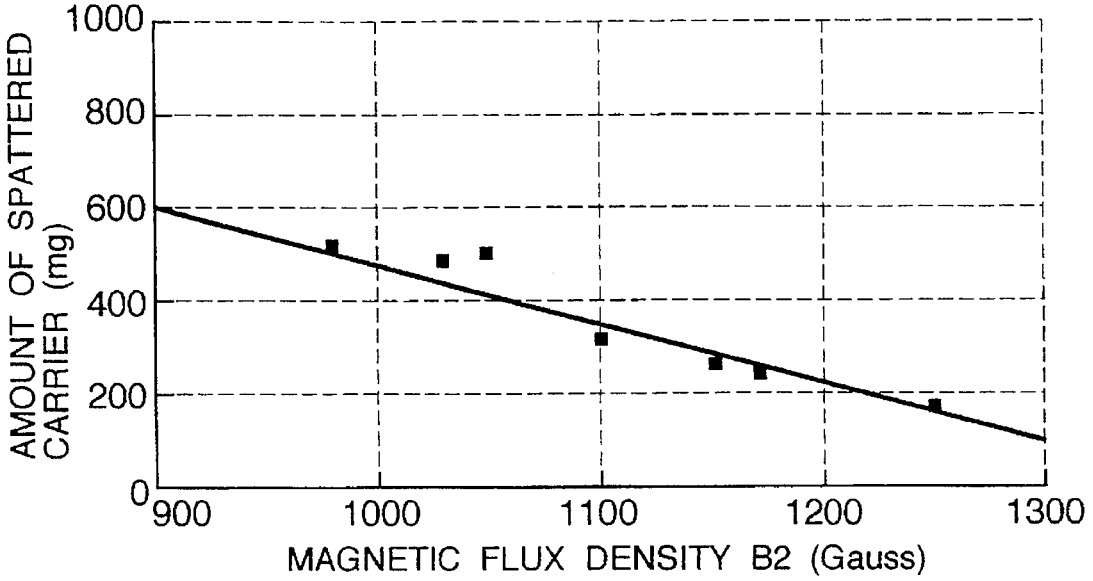
FIG. 6 is an explanatory graph showing the relationship between magnetic flux density B2 and amount of spattered carrier.
Figure 7:
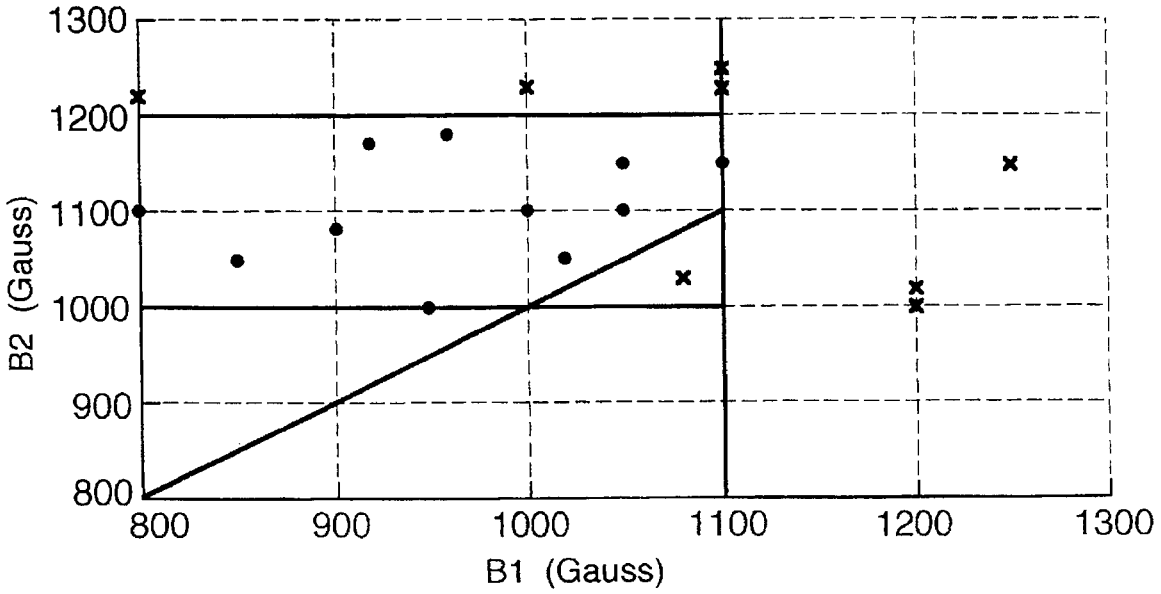
FIG. 7 is an explanatory graph showing the relationship between magnetic flux density B1 and magnetic flux density B2.

FIG. 6 shows the relationship between the magnetic flux density B2 and amount of attached carrier onto the printing body. The amount of attached carrier is measured by weighing the amount of attached carrier on a collecting member (a rare earth magnet) arranged for the experiment. The amount of attached carrier onto the printing body 1 decreases as the magnetic flux density B2 is increased since the force to magnetically held the carrier on the sleeve 13 is increased as the magnetic flux density B2 is increased. By setting the magnetic flux density B2 to 1000 gauss, the amount of attached carrier on the printing body 1 can be decreased smaller than 500 mg, and consequently there arises no problem in printing quality and no trouble due to spattering of carrier. By plotting the magnetic flux density B1 against the magnetic flux density B2 classified by defining both of the color mixing ratio and the carrier spattering to obtain FIG. 7. The straight lines A and B in the figure express the upper limits of the magnetic flux densities B1 and B2, respectively, in respect to color mixing, and the straight lines C and D express the range of (B1–B2). And the straight line E expresses the lower limit of the magnetic flux density B2 in respect to the carrier spattering. The mark • indicates an experimental point having a color mixing ratio smaller than 6% and the mark x indicates an experimental point having a color mixing ratio larger than 6%. From the figure, it can be understood that the range defined as above satisfies the color quality in respect to color mixing.

Figure 8:
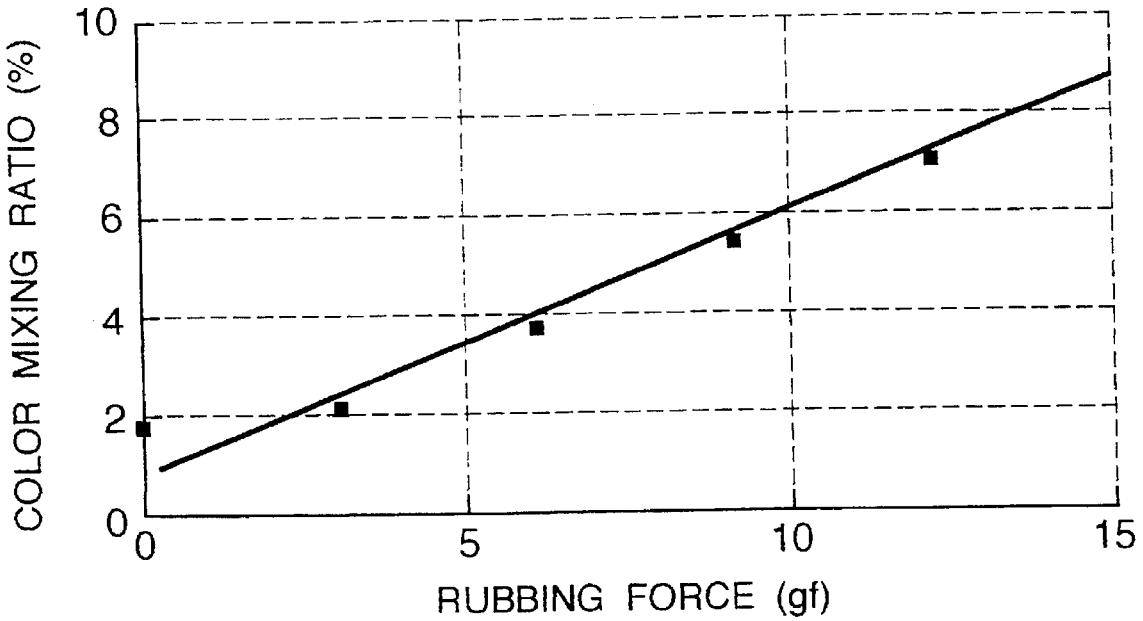
FIG. 8 is an explanatory graph showing the relationship between rubbing force and color mixing ratio.

FIG. 8 shows the relationship between rubbing force and the color mixing ratio. The rubbing force is obtained by detecting amount of torsion produced in the rotating shaft of printing body by contacting of the magnetic brush to the printing body using a micro-rotational load sensor. The rubbing force is produced by upright standing of the magnetic brush of the magnetic flux polarization pattern 15. Therefore, since the force rubbing a toner image on the printing body becomes large when the mechanical rubbing force by the magnetic brush increases, the color mixing ratio is increased. When the rubbing force is smaller than 0~10 gf, the color mixing ratio can be suppressed below 6%. Further, by selecting the condition of the magnetic flux polarization patterns 15, 17 to make the rubbing force to 0 (zero), the color mixing caused by the mechanical rubbing can be removed.

Although the above description has been made on the case where the developing unit and the developing method of the image forming apparatus are of the construction and the method described in FIG. 1, the construction of the developing unit such as the rotating direction of the developing agent holding body, number of the developing agent holding bodies, shape of the mixing member and so on are not limited thereto, but the effect of the present invention may be obtained in other constructions and methods. Further, although the embodiment has been described on the method where two color toners are superposed in two rotations of the photosensitive body, the same effect may be obtained in a method where multi-color developing is performed in multi-rotations of a photosensitive body or a method where multi-color toners are superposed in a single rotation. Furthermore, it is effective to employ a resin carrier in the developing agent since the rubbing force can be decreased.

As having been described above, according to the present invention, rubbing of the magnetic brush and spattering of carrier can be suppressed, and consequently it is possible to obtain an image having less faults and small color mixing due to carrier attachment.

What is claimed is:

1. An image printer comprising a first developing unit having a first developing agent holding body rotatably supported, forming a magnetic brush composed of a developing agent containing a toner and a carrier in the peripheral portion of the first developing agent holding body, developing a first electrostatic latent image formed on a printing body using the magnetic brush to form a first toner image onto said printing body;

a second developing unit having a first developing agent holding body rotatably supported, forming a magnetic brush composed of a developing agent containing a toner and a carrier in the peripheral portion of the second developing agent holding body, developing a second electrostatic latent image formed on said printing body using the magnetic brush to form a second toner image onto said printing body holding said first toner image; wherein two magnetic poles having the same polarity are provided adjacent to each other in a position facing said printing body of said second developing agent holding body provided in said second developing unit; development being performed under a condition satisfying the following formulas;

$$B1 \leqq 1100,$$

$$1000 \leqq B2 \leqq 1200,$$

$$-300 \leqq B1-B2 \leqq 0,$$

where B1 (gauss) is a magnetic flux density on the surface of said developing agent holding body of one magnetic pole of said magnetic poles arranged in the downstream side of the transmitting direction of said developing agent, and B2 (gauss) is a magnetic flux density on the surface of said developing agent holding body of the other magnetic pole of said magnetic poles arranged in the upstream side of the transmitting direction of said developing agent.

2. An image printer comprising a first developing unit having a first developing agent holding body rotatably supported, forming a magnetic brush composed of a developing agent containing a toner and a carrier in the peripheral portion of the first developing agent holding body, developing a first electrostatic latent image formed on a printing body using the magnetic brush to form a first toner image onto said printing body;

a second developing unit having a first developing agent holding body rotatably supported, forming a magnetic brush composed of a developing agent containing a toner and a carrier in the peripheral portion of the second developing agent holding body, developing a second electrostatic latent image formed on said printing body using the magnetic brush to form a second toner image onto said printing body holding said first toner image; wherein two magnetic poles having the same polarity are provided adjacent to each other in a position facing said printing body of said second developing agent holding body provided in said second developing unit; development being performed under a condition satisfying the following formulas;

$$B1 \leqq 1100,$$

$$1000 \leqq B2 \leqq 1200,$$

$$-300 \leqq B1-B2 \leqq 0,$$

$$F \approx 0$$

where B1 (gauss) is a magnetic flux density on the surface of said developing agent holding body of one magnetic pole of said magnetic poles arranged in the downstream side of the transmitting direction of said developing agent, and B2 (gauss) is a magnetic flux density on the surface of said developing agent holding body of the other magnetic pole of said magnetic poles arranged in the upstream side of the transmitting direction of said developing agent, and F (gf) is a rubbing force to the printing body of the magnetic brush in said second developing unit.

3. An image printer according to claim 1 or claim 2, said magnetic pole placed in the downstream side of the transmitting direction of said developing agent is arranged on a straight line connecting between the rotating center of said printing body and the rotating center of said developing agent holding body.

* * * * *